US012188701B2

(12) United States Patent
Perevozchikov et al.

(10) Patent No.: US 12,188,701 B2
(45) Date of Patent: Jan. 7, 2025

(54) SYSTEMS AND METHODS FOR PROVIDING COMPRESSOR COOLING

(71) Applicant: Copeland LP, Sidney, OH (US)

(72) Inventors: Michael M. Perevozchikov, Tipp City, OH (US); Matthew J. Swallow, Versailles, OH (US)

(73) Assignee: Copeland LP, Sidney, OH (US)

( * ) Notice: Subject to any disclaimer, the term of this patent is extended or adjusted under 35 U.S.C. 154(b) by 236 days.

(21) Appl. No.: 17/930,807

(22) Filed: Sep. 9, 2022

(65) Prior Publication Data

US 2024/0085075 A1 Mar. 14, 2024

(51) Int. Cl.

| | |
|---|---|
| ***F25B 49/02*** | (2006.01) |
| ***F25B 31/02*** | (2006.01) |
| ***F25B 39/00*** | (2006.01) |
| ***F25B 41/40*** | (2021.01) |

(52) U.S. Cl.

CPC ..... *F25B 49/02* (2013.01); *F25B 31/026* (2013.01); *F25B 39/00* (2013.01); *F25B 41/40* (2021.01); *F25B 2400/07* (2013.01); *F25B 2400/13* (2013.01); *F25B 2500/06* (2013.01); *F25B 2600/2515* (2013.01); *F25B 2700/21156* (2013.01)

(58) Field of Classification Search

CPC ..... F25B 49/02; F25B 31/006; F25B 31/008; F25B 31/026; F25B 41/40; F25B 2400/07; F25B 2400/13; F25B 2500/06; F25B 2600/2515; F25B 2700/21156; F25B 39/00

See application file for complete search history.

(56) References Cited

U.S. PATENT DOCUMENTS

| | | | |
|---|---|---|---|
| 3,165,905 | A | 1/1965 | Ware |
| 3,913,346 | A | 10/1975 | Moody, Jr. et al. |
| 4,573,324 | A | 3/1986 | Tischer et al. |
| 4,903,497 | A | 2/1990 | Zimmern |
| 5,582,002 | A | 12/1996 | Pattas |
| 5,692,389 | A | 12/1997 | Lord et al. |

(Continued)

OTHER PUBLICATIONS

International Search Report and Written Opinion issued by the International Searching Authority in Application No. PCT/US2023/073652 mailed on Dec. 14, 2023, pp. 1-13.

*Primary Examiner* — Marc E Norman

(74) *Attorney, Agent, or Firm* — Armstrong Teasdale LLP

(57) ABSTRACT

A vapor compression system includes a primary loop and a secondary loop. The primary loop includes a dynamic compressor operable to compress a refrigerant, a condenser fluidly connected to the dynamic compressor, a first expansion device fluidly connected to the condenser, and an evaporator fluidly connected to the first expansion device and the dynamic compressor. The dynamic compressor includes a housing, a shaft supported in the housing by a bearing, an impeller connected to the shaft, a motor operably connected to the shaft to drive rotation thereof, and a drive operable to control the motor. The secondary loop includes a second expansion device fluidly connected to the condenser, a heat exchanger fluidly connected to the second expansion device, the condenser, and the dynamic compressor, and a supply duct fluidly connected between the heat exchanger and the dynamic compressor to provide a flow of refrigerant to the bearing.

19 Claims, 15 Drawing Sheets

(56) References Cited

U.S. PATENT DOCUMENTS

| | | | | |
|---|---|---|---|---|
| 5,704,215 | A | 1/1998 | Lord et al. | |
| 6,032,472 | A | 3/2000 | Heinrichs et al. | |
| 8,465,265 | B2 | 6/2013 | De Larminat | |
| 8,516,850 | B2 | 8/2013 | Jadric et al. | |
| 10,018,393 | B2 | 7/2018 | Kopko et al. | |
| 10,184,701 | B2 | 1/2019 | Sun et al. | |
| 10,823,467 | B2 | 11/2020 | Jonsson et al. | |
| 11,035,382 | B2 * | 6/2021 | Espelien | F16K 37/0033 |
| 2014/0341710 | A1 * | 11/2014 | Creamer | F24F 11/86 415/203 |
| 2016/0116190 | A1 | 4/2016 | Oda et al. | |
| 2018/0180333 | A1 | 6/2018 | Sishtla et al. | |
| 2021/0285704 | A1 * | 9/2021 | Raimbault | F25B 41/40 |
| 2024/0085075 | A1 * | 3/2024 | Perevozchikov | F25B 40/00 |

* cited by examiner

SYSTEMS AND METHODS FOR PROVIDING COMPRESSOR COOLING

FIELD

The field of the disclosure relates generally to heating, ventilation, and air conditioning (HVAC) systems, and more particularly, to control systems for HVAC systems.

BACKGROUND

Dynamic compressors, including centrifugal compressors, are commonly used in process industries and in heating, ventilation, and air conditioning (HVAC) systems. The compressor is typically connected to a motor via a shaft that supports multiple compression stages. A drive controls the motor to rotate the compression stages at a rotational speed and loading condition selected to compress a refrigerant to a specified demand. The motor speed and load can be controlled to operate the compressor under a wide range of operating conditions.

During operation, the drive, motor, and compressor bearings can reach high temperatures that, if left unaddressed, may increase the risk of mechanical failure due to overheating. Many existing cooling systems divert low-temperature refrigerant from the main flow path to the components needing cooling. However, using liquid refrigerant for cooling creates the opportunity for liquid to enter the bearings or the high-speed impeller, degrading the performance and longevity of the compressor. Thus, there is a need for a compressor cooling system that uses only gaseous refrigerant as a cooling fluid.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the disclosure is directed to a vapor compression system including a primary loop and a secondary loop. The primary loop includes a dynamic compressor operable to compress a refrigerant, a condenser fluidly connected to the dynamic compressor, a first expansion device fluidly connected to the condenser, and an evaporator fluidly connected to the first expansion device and the dynamic compressor. The dynamic compressor includes a housing, a shaft supported in the housing by a bearing, an impeller connected to the shaft, a motor operably connected to the shaft to drive rotation thereof, and a drive operable to control the motor. The secondary loop includes a second expansion device fluidly connected to the condenser, a heat exchanger fluidly connected to the second expansion device, the condenser, and the dynamic compressor, and a supply duct fluidly connected between the heat exchanger and the dynamic compressor to provide a flow of refrigerant to the bearing.

Another aspect of the disclosure is directed to a controller for a compressor system. The compressor system includes a dynamic compressor and a cooling apparatus, and the cooling apparatus includes a heat exchanger and a supply duct fluidly connected between the heat exchanger and the dynamic compressor. The controller includes a processor and a memory that stores instructions that program the processor to operate the dynamic compressor to compress a refrigerant, operate the cooling apparatus to provide a flow of refrigerant through the supply duct to a bearing of the dynamic compressor, determine if a condition is satisfied, and adjust a position of a valve in fluid communication between the dynamic compressor and the cooling apparatus when the condition is satisfied.

Another aspect of the disclosure is directed to a compressor system including a dynamic compressor operable to compress a refrigerant and a cooling apparatus. The dynamic compressor includes a housing, a shaft supported in the housing by a bearing, and an impeller connected to the shaft. The cooling apparatus includes a heat exchanger fluidly connected to the dynamic compressor, a supply duct fluidly connected between the heat exchanger and the dynamic compressor to provide a flow of refrigerant to the bearing, a valve fluidly connected to the supply duct and selectively positionable to permit refrigerant to flow therethrough, and a controller operable to control the valve.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

For conciseness, examples will be described with respect to a centrifugal compressor. However, the methods and systems described herein may be applied to any suitable compressor. The bearings, motor, and drive of a dynamic compressor can be cooled with vapor injection by diverting portions of the main flow through a supplemental loop with a heat exchanger or flash tank. The gaseous refrigerant exiting the heat exchanger or flash tank can be selectively provided to the bearings, motor, or drive based on the measured and desired temperatures of those components.

Figure 1:
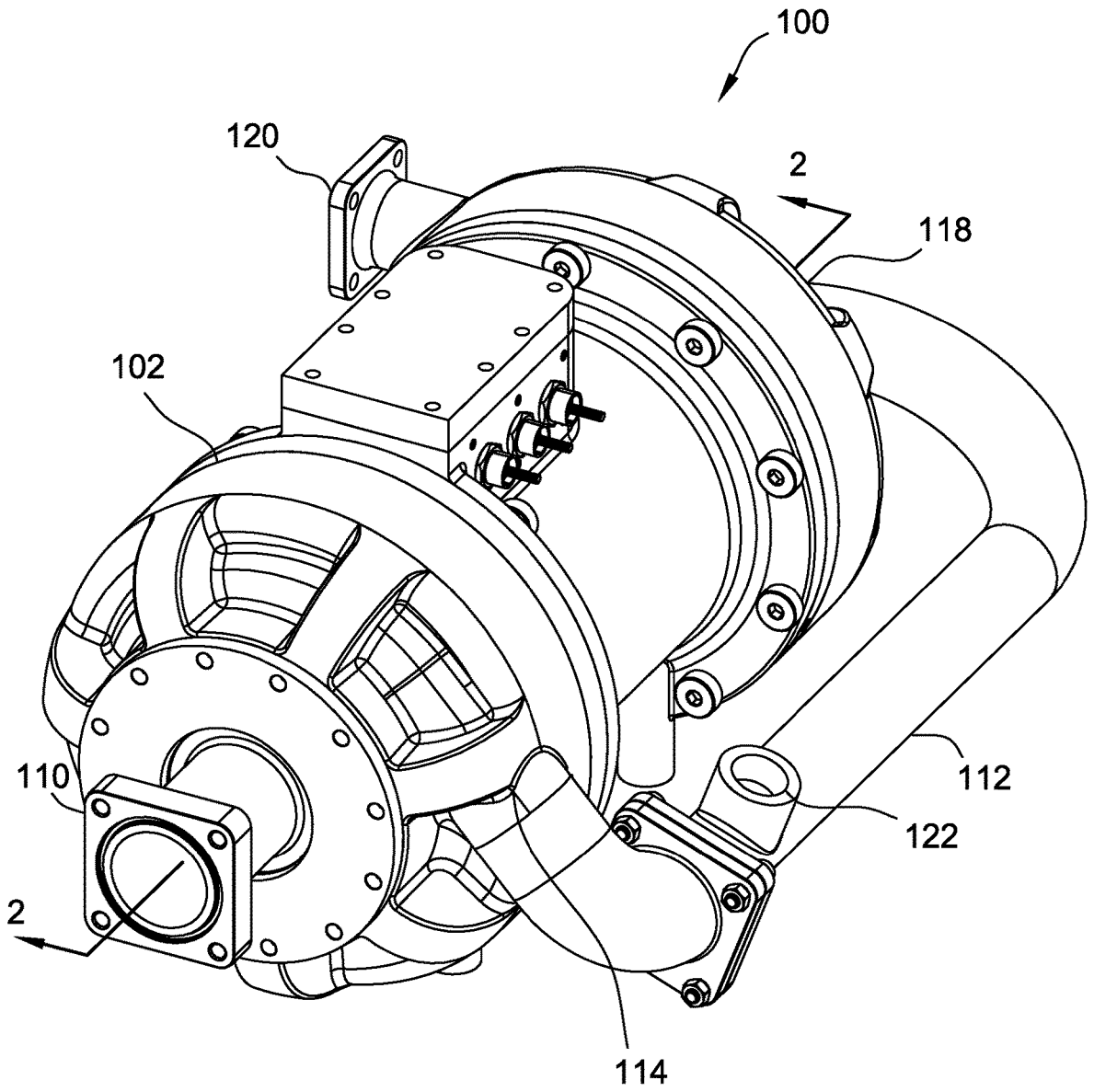
FIG. 1 is a perspective view of a dynamic compressor of one embodiment.

Referring to FIG. 1, a two-stage refrigerant compressor is indicated generally at 100. The compressor 100 is operable to compress a working fluid (e.g., refrigerant), and includes a compressor housing 102 that forms at least one sealed cavity within which each stage of refrigerant compression is accomplished. The compressor 100 includes a first refrigerant inlet 110 to introduce refrigerant vapor into the first compressor stage (not labeled in FIG. 1), a first refrigerant exit 114, a refrigerant transfer conduit 112 to transfer compressed refrigerant from the first compressor stage to the second compressor stage, a second refrigerant inlet 118 to introduce refrigerant vapor into the second compressor stage (not labeled in FIG. 1), and a second refrigerant exit 120. The refrigerant transfer conduit 112 is operatively connected at opposite ends to the first refrigerant exit 114 and the second refrigerant inlet 118, respectively. The refrigerant transfer conduit 112 further includes a port 122 for adding or removing flow between the first and second compressor stages. The second refrigerant exit 120 delivers compressed refrigerant from the second compressor stage to a cooling system in which compressor 100 is incorporated.

Figure 2:
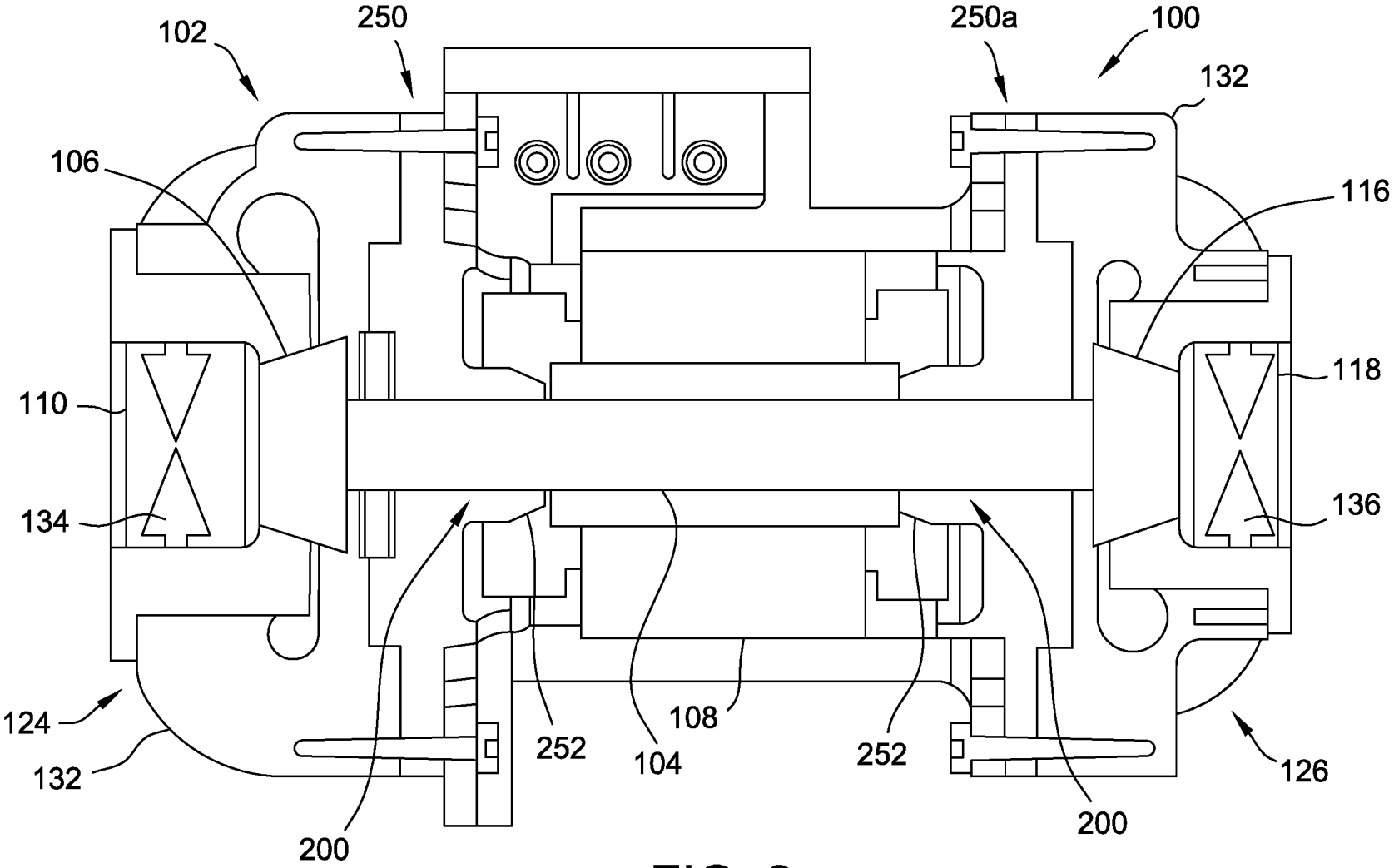
FIG. 2 is a cross-sectional view of the dynamic compressor of FIG. 1 taken along line 2-2 with the external conduit removed.

Referring to FIG. 2, the compressor housing 102 encloses a first compressor stage 124 and a second compressor stage 126 at opposite ends of the compressor 100. The first compressor stage 124 includes a first compression mechanism 106 configured to add kinetic energy to refrigerant entering via the first refrigerant inlet 110. In some embodiments, the first compression mechanism 106 is an impeller. The kinetic energy imparted to the refrigerant by the first compression mechanism 106 is converted to increased refrigerant pressure as the refrigerant velocity is slowed upon transfer to a sealed cavity (e.g., a diffuser) formed within the volute 132. The first compressor stage 124 additionally includes a first variable inlet guide vane (VIGV) 134 disposed upstream of the first compression mechanism 106 in the first refrigerant inlet 110. The first VIGV 134 includes a plurality of vanes whose position can be controlled to introduce pre-whirl into the gaseous refrigerant entering the first refrigerant inlet 110.

Similarly, the second compressor stage 126 includes a second compression mechanism 116 configured to add kinetic energy to refrigerant transferred from the first compressor stage 124 entering via the second refrigerant inlet 118. In some embodiments, the second compression mechanism 116 is an impeller. The kinetic energy imparted to the refrigerant by the second compression mechanism 116 is converted to increased refrigerant pressure as the refrigerant velocity is slowed upon transfer to a sealed cavity (e.g., a diffuser) formed within the volute 132. Compressed refrigerant exits the second compressor stage 126 via the second refrigerant exit 120 (not shown in FIG. 2). The second compressor stage 126 additionally includes a second variable inlet guide vane (VIGV) 136 disposed upstream of the second compression mechanism 116 in the second refrigerant inlet 118. The second VIGV 136 includes a plurality of vanes whose position can be controlled to introduce pre-whirl into the gaseous refrigerant entering the second refrigerant inlet 118.

The first compression mechanism 106 and second compression mechanism 116 are connected at opposite ends of a shaft 104. The shaft 104 is operatively connected to a motor 108 positioned between the first compression mechanism 106 and second compression mechanism 116 such that the first compression mechanism 106 and second compression mechanism 116 are rotated at a rotation speed selected to compress the refrigerant to a pre-selected pressure exiting the second refrigerant exit 120 (not shown in FIG. 2). Any suitable motor may be incorporated into the compressor 100 including, but not limited to, an electrical motor. The motor 108 may include a motor temperature sensor (not shown) operable to determine a temperature of the motor. The motor temperature sensor may be a thermocouple, thermistor, resistance temperature detector (RTD), or any other suitable sensor. The shaft 104 is rotatably supported by gas foil bearing assemblies 200 positioned within a sleeve 252 of each bearing housing **250/250*a*, as described in additional detail below. Each bearing housing 250/250*a* includes a mounting structure for connecting the respective bearing housing 250/250*a* to the compressor housing 102**.

Figure 3:
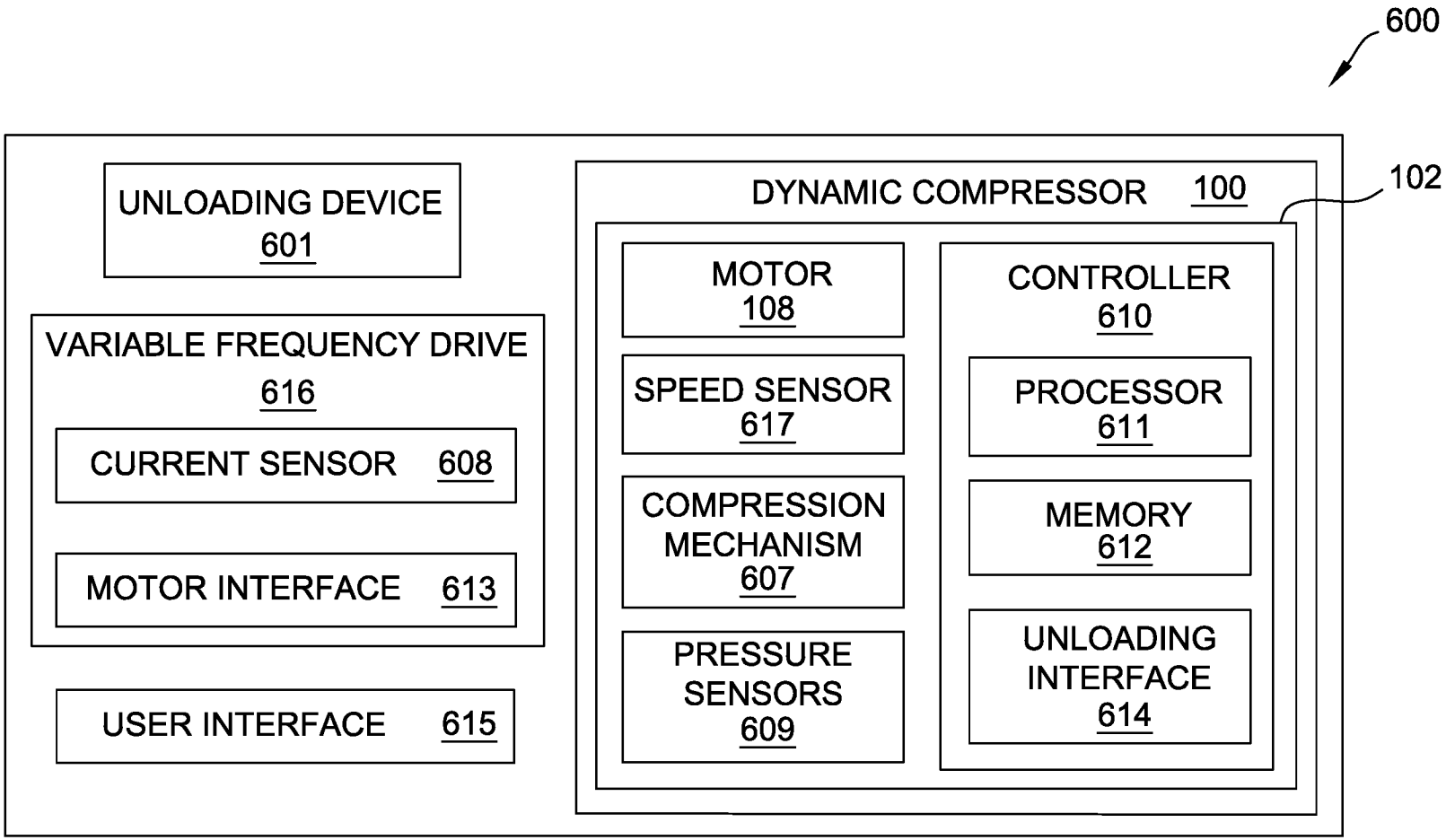
FIG. 3 is a block diagram of a control system for the dynamic compressor shown in FIGS. 1 and 2.

FIG. 3 shows an example embodiment of a system 600 including the dynamic compressor 100. The system 600 may be any suitable system in which the dynamic compressor 100 may be installed. The compressor 100 includes a compressor housing 102, a compression mechanism 607, a motor 108, a speed sensor 617, pressure sensors 609 and a controller 610. In the present embodiment, the dynamic compressor 100 is a two-stage centrifugal compressor, and the compression mechanism 607 is an impeller in each stage. In other embodiments, the dynamic compressor 100 may be an axial compressor, and the compression mechanism 607 may be an axial rotor. The speed sensor 617 measures the rotational speed of the compressor 100, and the pressure sensors 609 measure pressure at various points along the compressor flow path, including at the refrigerant inlet and the refrigerant exit. Additional sensors may be installed in the compressor 100 to provide data on its operation, including but not limited to temperature sensors, flow sensors, current sensors 608, voltage sensors, rotational rate sensors, and any other suitable sensors. The compressor 100 is not limited to a specific construction in the system 600 and may be constructed similarly to the compressor 100 described in FIGS. 1 and 2 or may be constructed in a different manner. The system 600 further includes an unloading device 601, a variable frequency drive 616 operable to control the motor 108, and a user interface 615.

A controller 610 is operatively connected to the dynamic compressor 100 to control its operation based in part on the measured parameters described above. The controller 610 includes a processor 611, a memory 612, and an unloading interface 614. The memory 612 stores instructions that program the processor 611 to determine whether the bearing assembly(s) 200, motor 108, and/or drive 616 require cooling, which will be discussed in greater detail further below. The system 600 includes an interface for connection of the controller 610 to the drive 616 and a motor interface 613 for connection of the drive 616 to the motor 108. In certain embodiments, the drive 616 operates under the control of the controller 610. In further embodiments, the drive 616 is a part of the controller 610. The drive 616 may include a drive temperature sensor (not shown) operable to determine a temperature of the drive. The drive temperature sensor may be a thermocouple, thermistor, resistance temperature detector (RTD), or any other suitable sensor. The system 600 further includes an unloading interface 614 for connection of the controller 610 to the unloading device 601.

The controller 610 is operatively coupled to the unloading device 601 through the unloading interface 614, which removes and/or reduces the load on the compressor 100 during start-up and shut-down routines, during detected surge events, and when otherwise instructed by the controller 610 to do so. In the example embodiment, the unloading device 601 is a variable inlet guide vane (VIGV) at the inlet of each impeller stage (FIG. 2). In other embodiments, the unloading device 601 may be a variable diffuser, a bypass valve, or any suitable device or combination of devices that reduces the load on the compressor 100. The unloading device 601 may additionally or alternatively be used as a loading device to increase the load on the compressor 100. The controller 610 is configured to control at least one operating parameter of the unloading device 601, such as a position of each VIGV.

The system 600 further includes a user interface 615 configured to output (e.g., display) and/or receive information (e.g., from a user) associated with the system 600. In some embodiments, the user interface 615 is configured to receive an activation and/or deactivation input from a user to activate and deactivate (i.e., turn on and off) or otherwise enable operation of the system 600. Moreover, in some embodiments, the user interface 615 is configured to output information associated with one or more operational characteristics of the system 600, including, for example and without limitation, warning indicators such as severity alerts, occurrence alerts, fault alerts, motor speed alerts, and any other suitable information.

The user interface 615 may include any suitable input devices and output devices that enable the user interface 615 to function as described herein. For example, the user interface 615 may include input devices including, but not limited to, a keyboard, mouse, touchscreen, joystick(s), throttle(s), buttons, switches, and/or other input devices. Moreover, the user interface 615 may include output devices including, for example and without limitation, a display (e.g., a liquid crystal display (LCD) or an organic light emitting diode (OLED) display), speakers, indicator lights, instruments, and/or other output devices. Furthermore, the user interface 615 may be part of a different component, such as a system controller (not shown). Other embodiments do not include a user interface 615.

The controller 610 is generally configured to control operation of the dynamic compressor 100. The controller 610 controls operation through programming and instructions from another device or controller or is integrated with the system 600 through a system controller. In some embodiments, for example, the controller 610 receives user input from the user interface 615, and controls one or more components of the system 600 in response to such user inputs. For example, the controller 610 may control the motor 108 based on user input received from the user interface 615. In some embodiments, the system 600 may be controlled by a remote control interface. For example, the system 600 may include a communication interface (not shown) configured for connection to a wireless control interface that enables remote control and activation of the system 600. The wireless control interface may be embodied on a portable computing device, such as a tablet or smartphone.

The controller 610 may generally include any suitable computer and/or other processing unit, including any suitable combination of computers, processing units and/or the like that may be communicatively coupled to one another and that may be operated independently or in connection within one another (e.g., controller 610 may form all or part of a controller network). Controller 610 may include one or more modules or devices, one or more of which is enclosed within system 600, or may be located remote from system 600. The controller 610 may be part of compressor 100 or separate and may be part of a system controller in an HVAC system. Controller 610 and/or components of controller 610 may be integrated or incorporated within other components of system 600. The controller 610 may include one or more processor(s) 611 and associated memory device(s) 612 configured to perform a variety of computer-implemented functions (e.g., performing the calculations, determinations, and functions disclosed herein).

As used herein, the term "processor" refers not only to integrated circuits, but also to a controller, a microcontroller, a microcomputer, a programmable logic controller (PLC), an application-specific integrated circuit, and other programmable circuits. Additionally, memory device(s) 612 of controller 610 may generally be or include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 612 may generally be configured to store suitable computer-readable instructions that, when implemented by the processor(s) 611, configure or cause the controller 610 to perform various functions described herein including, but not limited to, controlling the system 600, controlling operation of the motor 108, receiving inputs from user interface 615, providing output to an operator via user interface 615, controlling the unloading device 601 and/or various other suitable computer-implemented functions.

Figure 4:
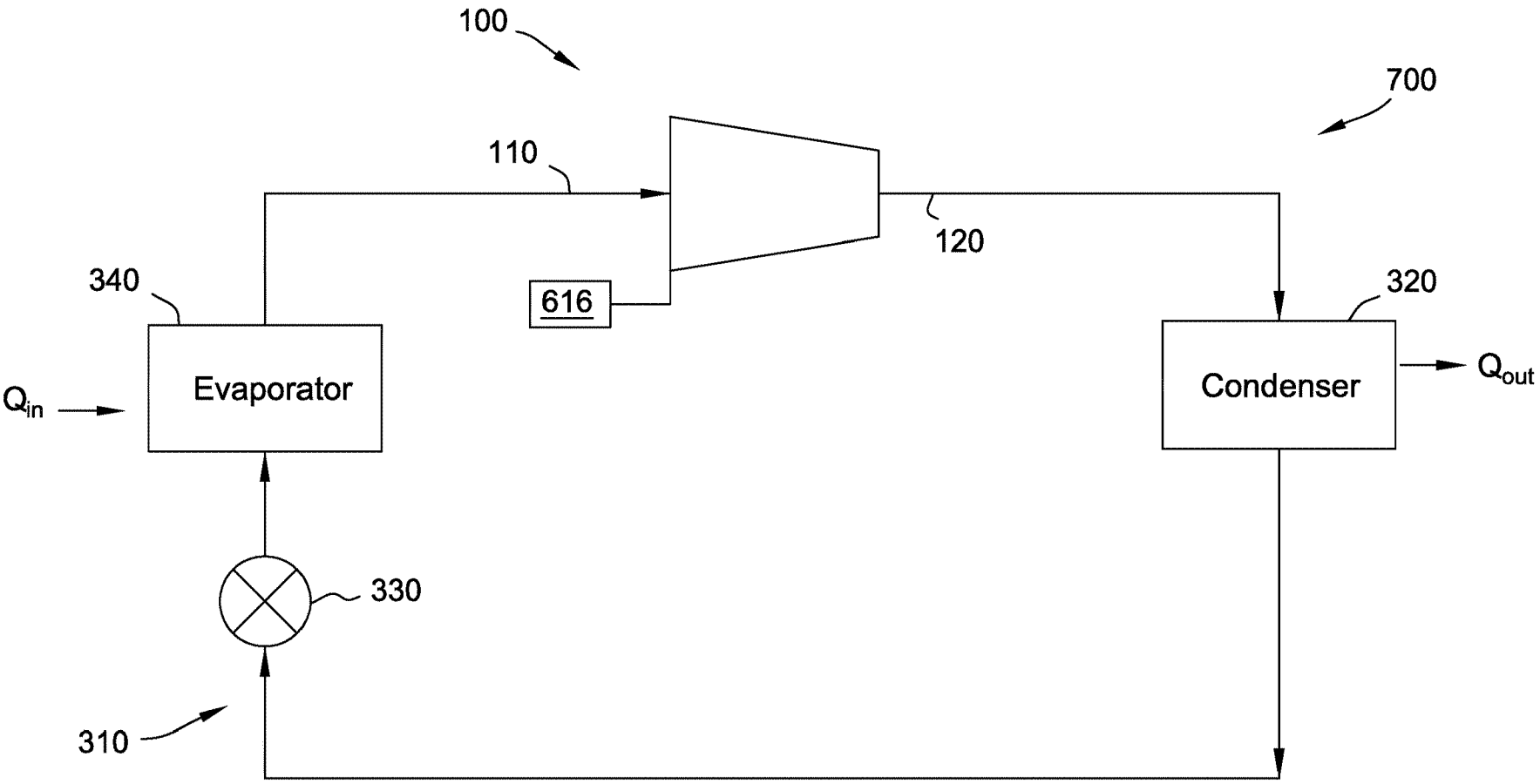
FIG. 4 is a schematic view of a first example vapor compression system in which the dynamic compressor shown in FIGS. 1 and 2 can be installed.

FIG. 4 is a schematic diagram of a first example vapor compression system 700 in which the dynamic compressor 100 of FIGS. 1 and 2 may be installed. The system 700 shown in FIG. 4 has a single, closed refrigerant loop 310 that includes the compressor 100, a condenser 320, a first expansion device 330, and an evaporator 340. In further embodiments (not shown), the system 700 may include multiple refrigerant loops to accommodate multiple compressors 100. Refrigerant enters the dynamic compressor 100 at the first refrigerant inlet 110 as a low-pressure, low-temperature gas. The dynamic compressor 100 adds kinetic energy to the refrigerant and converts it to pressure rise, and the refrigerant exits the dynamic compressor 100 at the second refrigerant exit 120 as a high-pressure, high-temperature gas. The refrigerant enters the condenser 320, which is fluidly connected to the compressor 100, and heat $Q_{out}$ is removed to convert the refrigerant gas into a high-pressure, high-temperature liquid.

The condenser 320 is fluidly connected to the first expansion device 330, which reduces the pressure of the refrigerant. In some embodiments, the pressure may be reduced until the liquid refrigerant's current temperature becomes the boiling point temperature at that pressure, and the refrigerant becomes a two-phase mixture as some of the liquid refrigerant boils and turns into a gas. The first expansion device 330 may be a fixed orifice, a thermal expansion valve, an electronic expansion valve, or any type of expansion device that allows the vapor compression system 700 to function as described herein. The first expansion device 330 is fluidly connected to the evaporator 340, which receives low-pressure, low-temperature liquid refrigerant or a two-phase mixture of liquid and gaseous refrigerant at its inlet. In the evaporator 340, the refrigerant absorbs heat $Q_{in}$ to change phase from a liquid to a gas. The evaporator 340 is fluidly connected to the compressor 100, and the cycle begins again.

Figure 5:
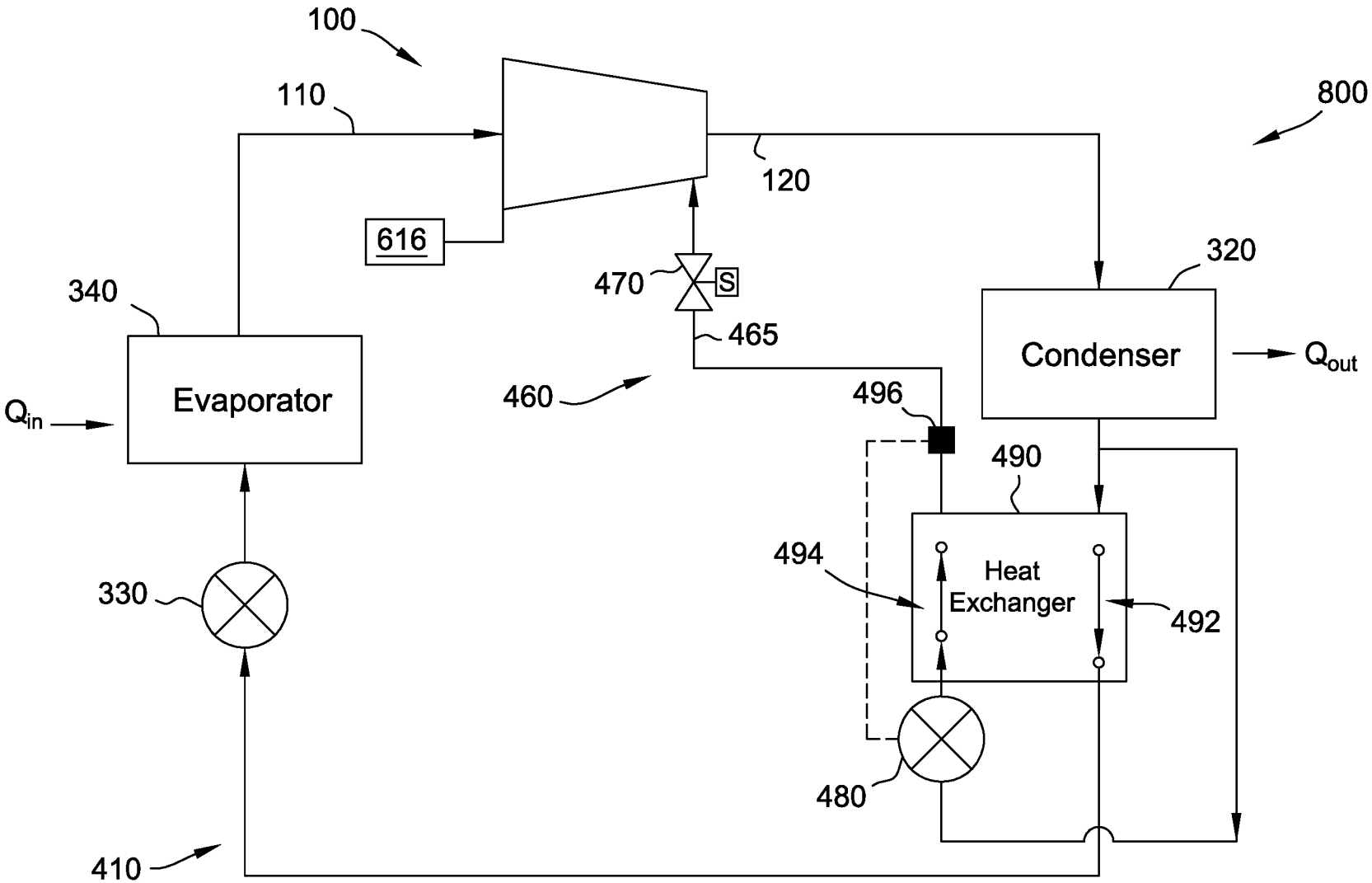
FIG. 5 is a schematic view of a second example vapor compression system in which the dynamic compressor shown in FIGS. 1 and 2 can be installed.

FIG. 5 is a schematic diagram of a second example vapor compression system 800 in which the dynamic compressor 100 of FIGS. 1 and 2 may be installed. The system 800 has a primary refrigerant loop 410 that includes the dynamic compressor 100, the condenser 320, a first stream 492 of a heat exchanger 490, the first expansion device 330, and the evaporator 340. The system 800 also has a secondary refrigerant loop 460 that is fluidly connected to a portion of the primary refrigerant loop 410 and controlled by an economization valve 470, which will be described in further detail herein.

The secondary refrigerant loop 460 includes the second expansion device 480, a second stream 494 of the heat exchanger 490, the economization valve 470, the second compressor stage 126 (FIG. 2) of the compressor, and the condenser 320. In the embodiment illustrated in FIG. 5, the components of the secondary refrigerant loop 460 are fluidly connected in the order in which they are listed, with the condenser 320 being additionally coupled to the second expansion device 480 to close the secondary refrigerant loop 460.

The economization valve 470 is controlled by the controller 610 to be fully open, partially open, or fully closed, and the economization valve's 470 status determines whether refrigerant will flow through the secondary refrigerant loop 460. That is, when the economization valve 470 is fully closed, all of the refrigerant will flow through the primary refrigerant loop 410, and the system 800 will operate in substantially the same way as the system 700 illustrated in FIG. 4. When the economization valve 470 is open, the liquid refrigerant exiting the condenser 320 separates into two streams, with the majority of refrigerant flowing through the primary refrigerant loop 410, and the remainder being diverted through the secondary refrigerant loop 460. The economization valve 470 can be a solenoid valve, electronic expansion valve, or any type of valve that allows the system 800 to function as described herein.

When the economization valve 470 is open, the condenser 320 is fluidly connected to the second expansion device 480, which reduces the pressure of the liquid economizer flow until the liquid refrigerant's current temperature becomes the boiling point temperature at that pressure. The refrigerant in the secondary refrigerant loop becomes a two-phase mixture as some of the liquid refrigerant boils and turns into a gas as it enters the heat exchanger 490. The second expansion device can be sized and selected to divert a particular amount of refrigerant through the secondary refrigerant loop 460 when the economization valve 470 is open, for example, 0 to 20 percent of the total mass flow, or any amount of refrigerant flow that allows the system 800 to function as described herein.

In some embodiments, the second expansion device 480 is a thermal expansion valve (TXV) that adjusts the amount of refrigerant flow through the secondary refrigerant loop 460 based on the thermal load of the heat exchanger 490. The TXV works in combination with a bulb 496 located downstream of the second stream 494 of the heat exchanger 490. A membrane inside the TXV is movable to balance the refrigerant pressure inside the bulb with the refrigerant pressure upstream of the heat exchanger 490. The movement of the membrane is coupled to a needle that sets the position of the valve, thereby controlling the amount of refrigerant that flows through the secondary refrigerant loop 460. In further embodiments, the second expansion device 480 can also be a fixed orifice, an electronic expansion valve, or any type of expansion device that allows the system 800 to function as described herein.

The refrigerant exits the second expansion device 480 and enters the second stream 494 of the heat exchanger 490 as a low-pressure liquid or two-phase mixture. The second stream 494 comes into thermal communication with the first stream 492, which carries high-pressure liquid refrigerant from the condenser 320 in the primary refrigerant loop 410. The thermal contact between the two streams 492, 494 cools the refrigerant in the first stream 492 and warms the refrigerant in the second stream 494, causing it to boil. The cooled refrigerant in the first stream 492 exits the heat exchanger 490 as a lower-temperature, high-pressure liquid, and the boiled refrigerant in the second stream 494 exits the heat exchanger 490 as a low-temperature, intermediate-pressure gas. The heat exchanger 490 may be a counterflow heat exchanger, a cross-flow heat exchanger, a parallel flow heat exchanger, a shell and tube heat exchanger, a mixing chamber, or any type of heat exchanger that allows the system 800 to function as described herein. In further embodiments, a flash tank may be used instead of or in addition to the heat exchanger 490. Such embodiments will be shown and described further below.

The low-temperature, intermediate-pressure gas exiting the second stream 494 of the heat exchanger 490 then flows through an economization duct 465 and is injected into the refrigerant transfer conduit 112 (FIG. 2) of the compressor 100 to be mixed with the refrigerant flow of the primary refrigerant loop 410 before it reaches the second compressor stage 126. The primary and secondary refrigerant loops 410, 460 converge at the second compressor stage 126, and diverge once again after the refrigerant exits the condenser 320.

Figure 6:
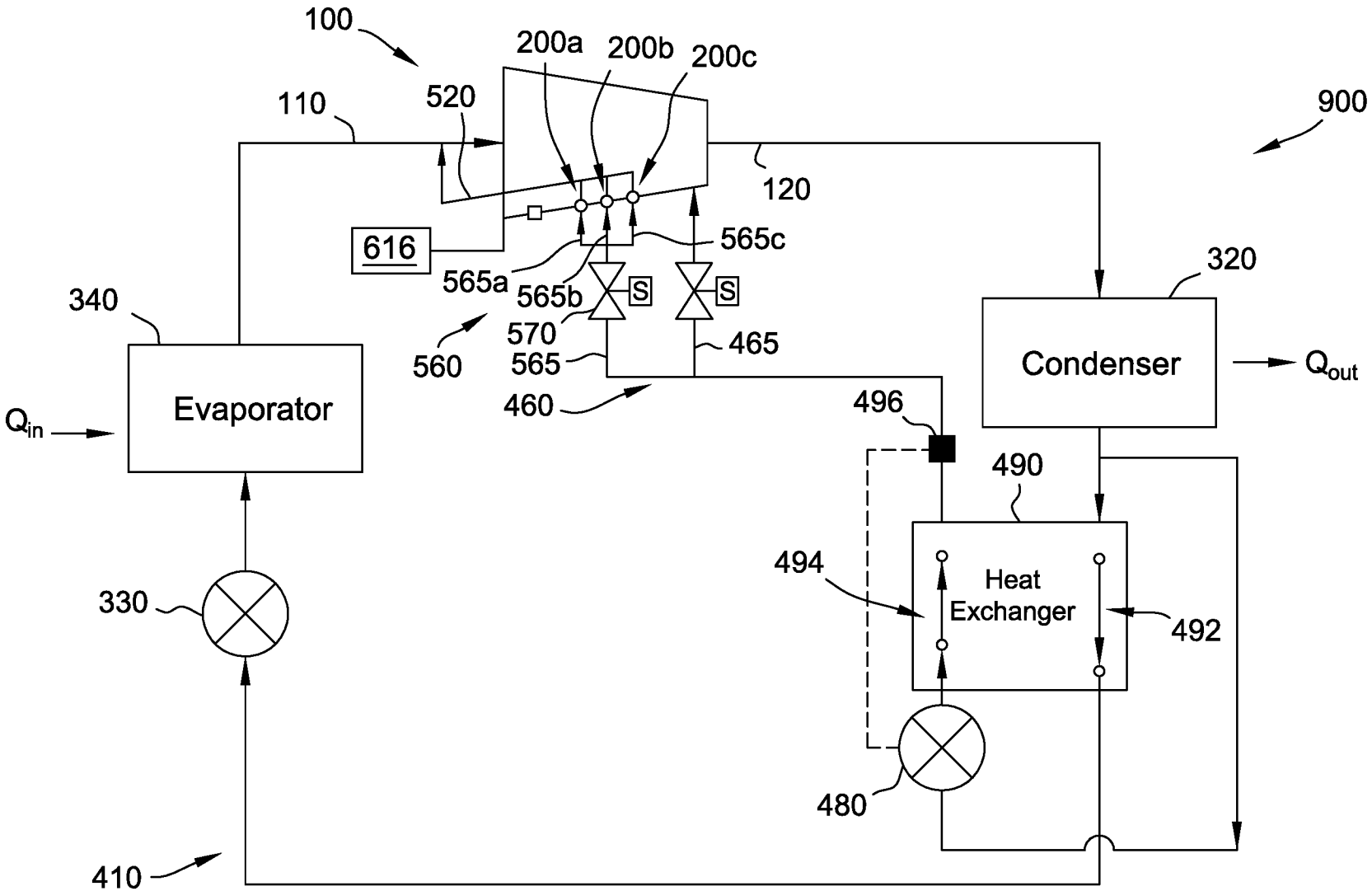
FIG. 6 is a schematic view of a third example vapor compression system in which the dynamic compressor shown in FIGS. 1 and 2 can be installed.

FIG. 6 is a schematic diagram of a third example vapor compression system 900 in which the dynamic compressor 100 of FIGS. 1 and 2 may be installed. In addition to all of the components shown and described with respect to the second example vapor compression system 800 shown and described with respect to FIG. 5, the system 900 further includes a cooling apparatus 560 that forms part of the secondary refrigerant loop 460. The cooling apparatus 560 includes the heat exchanger 490 and a first supply duct 565 fluidly connected between the heat exchanger 490 and the dynamic compressor 100. The secondary refrigerant loop 460 diverges downstream of the heat exchanger 490 into the economization duct 465 and the first supply duct 565. A portion of the refrigerant flow in the secondary refrigerant loop 460 flows through the economization duct 465, as described above with respect to the second example vapor compression system 800, and the remainder flows through the first supply duct 565 to provide a first flow of refrigerant to at least one bearing assembly 200 of the dynamic compressor 100.

The first supply duct 565 includes a first valve 570 fluidly connected thereto. The first valve 570 is controlled by the controller 610 and is selectively positionable to permit refrigerant to flow therethrough. When the first valve 570 is fully closed, all of the refrigerant in the secondary refrigerant loop 460 will flow through the economization duct 465, and the system 900 will operate in substantially the same manner as the system 800 illustrated in FIG. 5. When the first valve 570 is fully or partially open, the gaseous or two-phase refrigerant exiting the heat exchanger 490 separates into two streams, with a portion of refrigerant flowing through the economization duct 465, and the remainder being diverted through the first supply duct 565. The first valve 570 can be a solenoid valve (as shown in FIG. 6), an electronic expansion valve, or any type of valve that allows the system 900 to function as described herein.

When the first valve 570 is open, the first supply duct 565 provides a first flow of refrigerant to facilitate cooling of at least one bearing assembly 200 of the dynamic compressor 100. In the illustrated embodiment, the first supply duct 565 diverges into first, second, and third streams 565*a-c* that respectively provide the first refrigerant flow to a first radial bearing 200*a*, a second radial bearing 200*b*, and a thrust bearing 200*c* of the dynamic compressor 100. In some embodiments, the first, second, and third streams 565*a-c* may each include a valve (not shown) operable to control the flow of refrigerant therethrough.

The cooling apparatus 560 further includes a return duct 520 that fluidly connects the first supply duct 565 to the dynamic compressor 100 to provide a return flow of refrigerant thereto. The return duct 520 collects refrigerant from downstream of the cooled bearings and returns the refrigerant to the inlet 110 of the first compressor stage 124. In the illustrated embodiment, each of the first, second, and third streams 565*a-c* of the first supply duct 565 converge downstream of their respective bearings 200*a-c* to form the return duct 520. The return flow is mixed with the refrigerant flow upstream of the inlet 110 such that the primary and secondary refrigerant loops 410, 460 converge. The return duct 520 may include a return temperature sensor (not shown) operable to measure a return flow temperature $T_r$. The return temperature sensor may be a thermocouple, thermistor, or any suitable temperature sensor.

Figure 7:
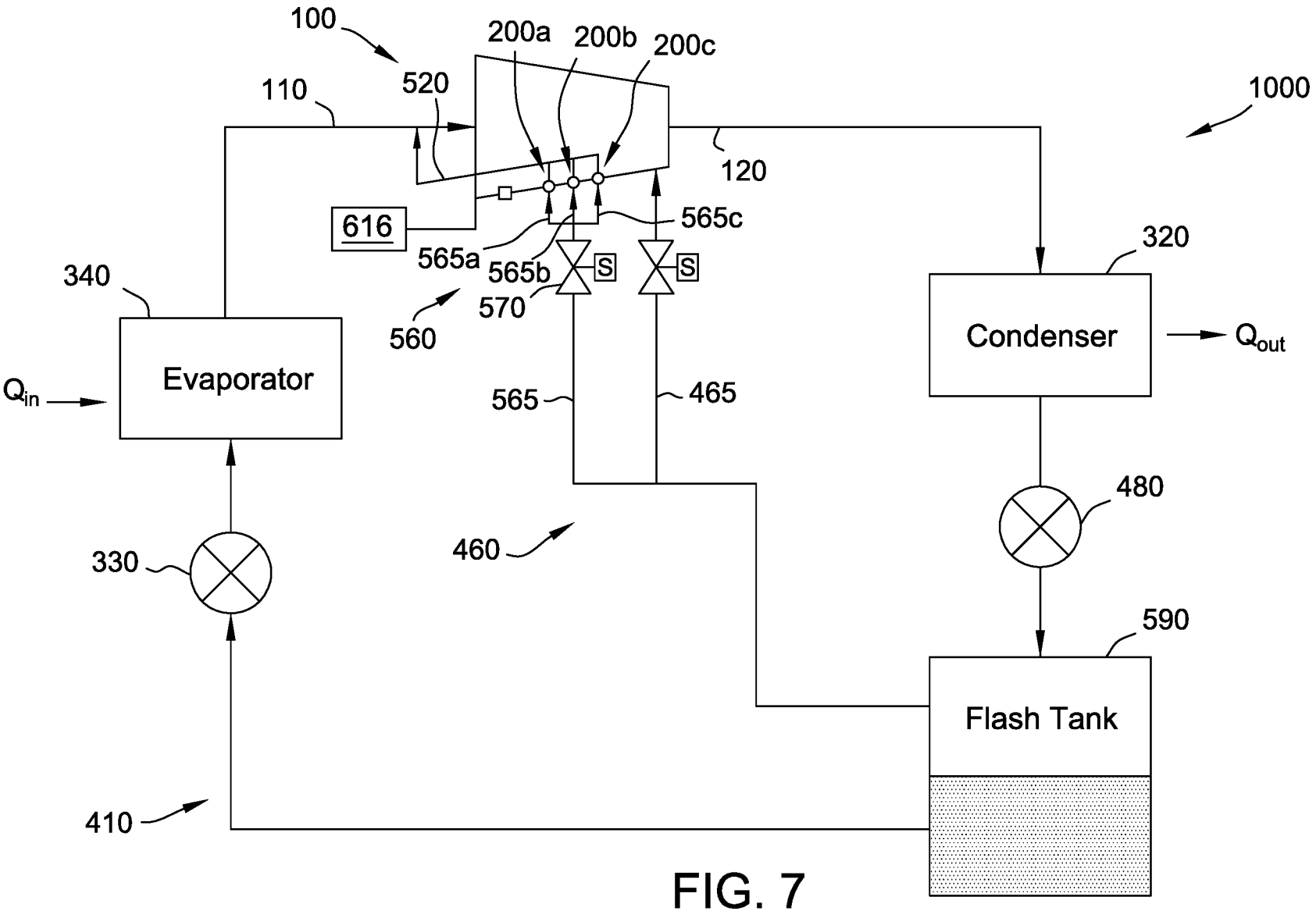
FIG. 7 is a schematic view of an alternative embodiment of the third example vapor compression system shown in FIG. 6.

An alternate embodiment of the third example vapor compression system 900 is shown in FIG. 7, in which the heat exchanger is replaced with a flash tank 590. Downstream of the condenser 320, the refrigerant flow is throttled through the expansion device 480, reducing its pressure until some of the liquid refrigerant boils off, creating a two-phase mixture. The flash tank 590 separates the two-phase refrigerant mixture into liquid and gaseous fractions, which respectively diverge into the primary and secondary refrigerant loops 410, 460. In certain embodiments, a heat exchanger may be used instead of or in addition to the flash tank 590. The refrigerant then flows along the primary and secondary refrigerant loops 410, 460 as described above with respect to FIG. 6.

Figure 8:
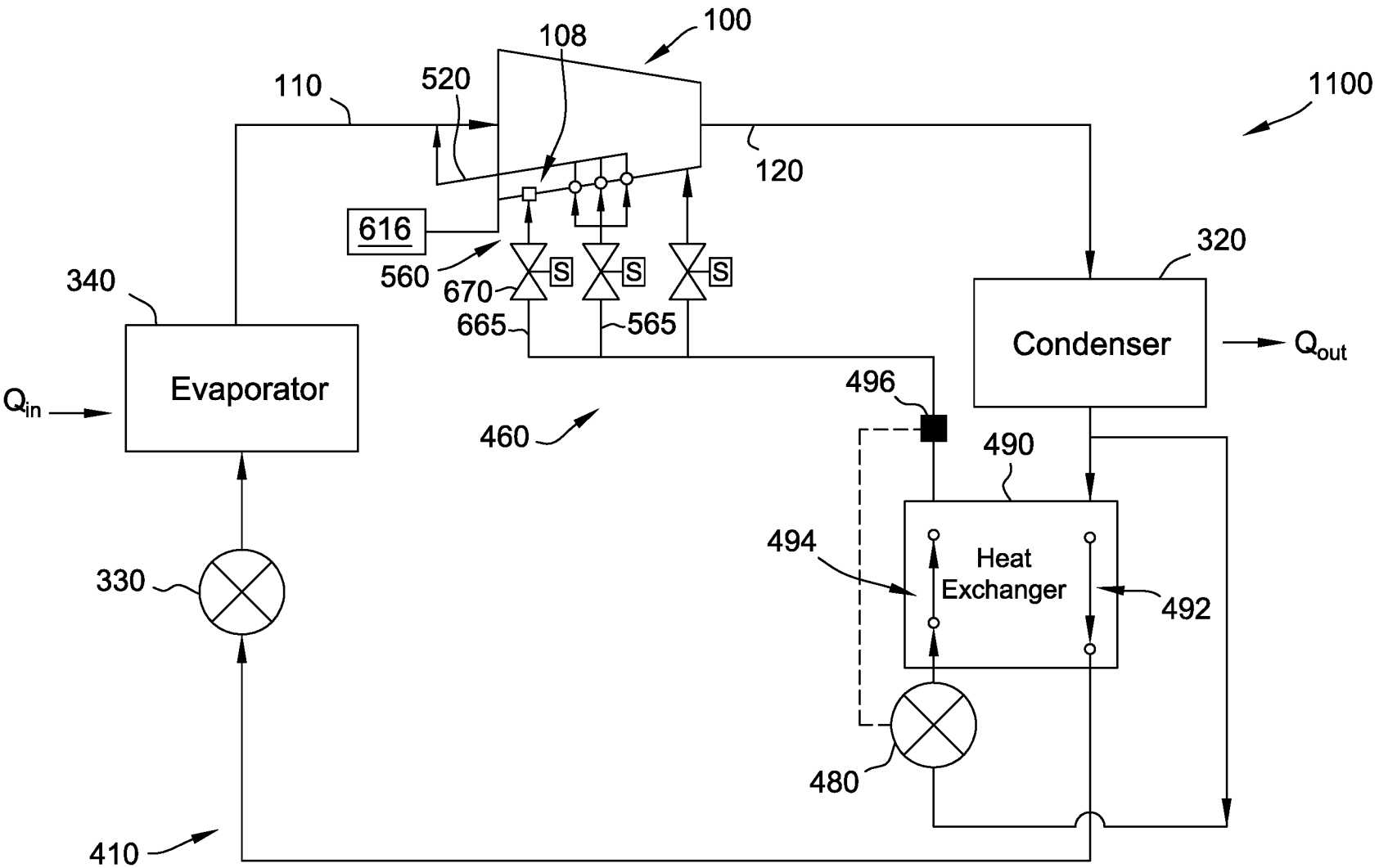
FIG. 8 is a schematic view of a fourth example vapor compression system in which the dynamic compressor shown in FIGS. 1 and 2 can be installed.

FIG. 8 is a schematic diagram of a fourth example vapor compression system 1100 in which the dynamic compressor 100 of FIGS. 1 and 2 may be installed. In addition to the components shown and described with respect to the third example vapor compression system 900 shown in FIG. 6, the cooling apparatus 560 of the system 1100 further includes a second supply duct 665 fluidly connected between the heat exchanger 490 and the motor 108. The secondary refrigerant loop 460 diverges downstream of the heat exchanger 490 into the economization duct 465, the first supply duct 565, and the second supply duct 665. Portions of the refrigerant flow in the secondary refrigerant loop 460 flow through the economization duct 465 and the first supply duct, as described above with respect to the third example vapor compression system 900. The remainder of the refrigerant flow in the secondary refrigerant loop 460 flows through the second supply duct 665 to provide a second flow of refrigerant to the motor 108.

The second supply duct 665 includes a second valve 670 fluidly connected thereto. The second valve 670 is controlled by the controller 610 and selectively positionable to permit refrigerant to flow therethrough. When the second valve 670 is fully closed, and when at least one of the economization valve 470 and the first valve 570 are open, all of the refrigerant in the secondary refrigerant loop 460 will flow through the economization duct 465 and/or the first supply duct 565, and the system 1100 will operate in substantially the same manner as the system 900 illustrated in FIG. 6. When the second valve 670 is fully or partially open, the gaseous or two-phase refrigerant exiting the heat exchanger 490 separates into up to three streams, with a portion of refrigerant flowing through the economization duct 465, another portion flowing through the first supply duct 565, and the remainder being diverted through the second supply duct 665. The second valve 670 can be a solenoid valve (as shown in FIG. 8), an electronic expansion valve, or any type of valve that allows the system 1100 to function as described herein.

When the second valve 670 is open, the second supply duct 665 provides a second flow of refrigerant to facilitate cooling of the motor 108. The second supply duct 665 is fluidly connected to the return duct 520, and the first and second flows combine to form the return flow that is mixed with the refrigerant flow upstream of the compressor inlet 110.

Figure 9:
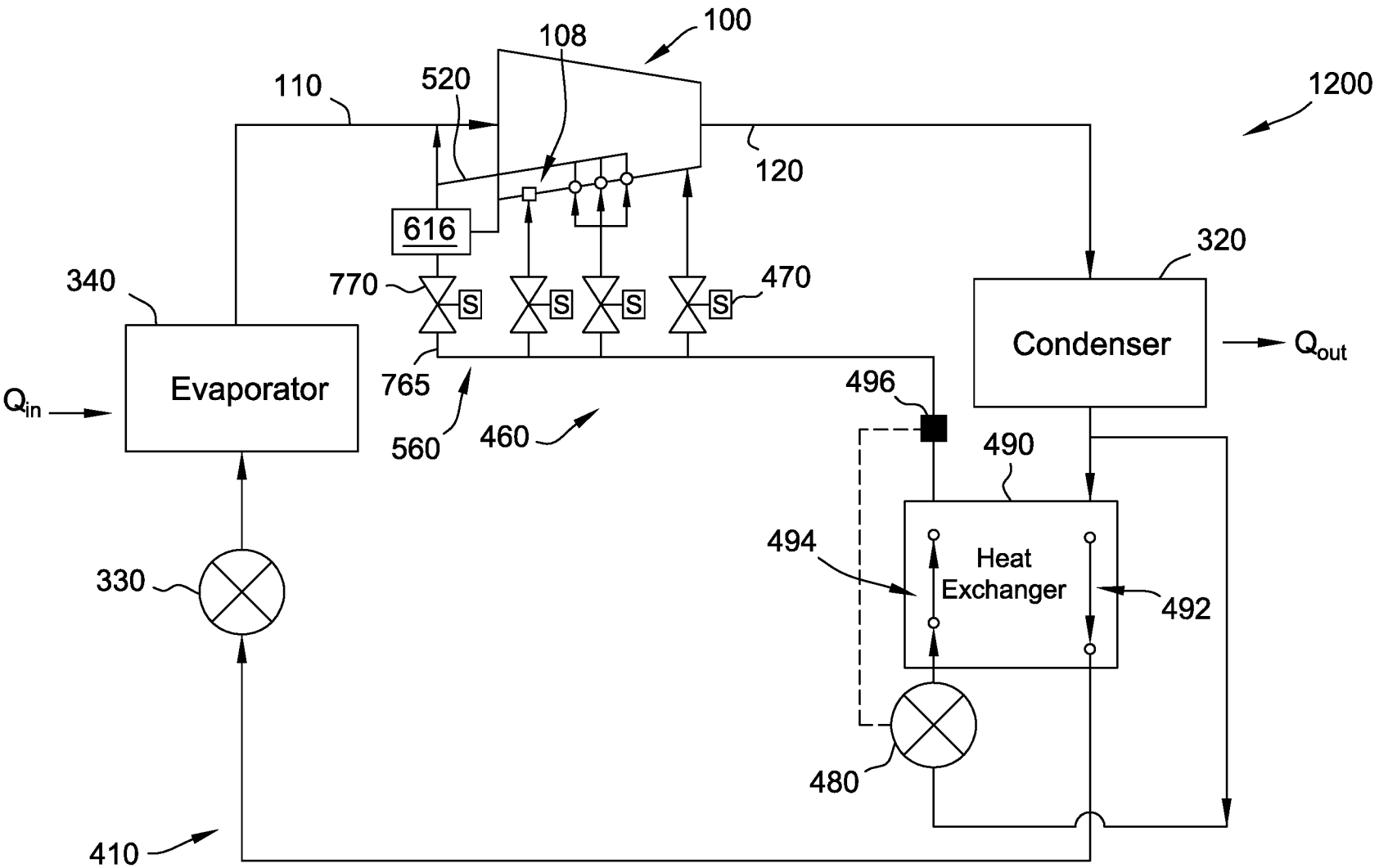
FIG. 9 is a schematic view of a fifth example vapor compression system in which the dynamic compressor shown in FIGS. 1 and 2 can be installed.

FIG. 9 illustrates a fifth example vapor compression system 1200 in which the dynamic compressor 100 of FIGS. 1 and 2 may be installed. In addition to all of the components shown and described with respect to the fourth example vapor compression system 1100 shown in FIG. 8, the cooling apparatus 560 of the system 1200 further includes a third supply duct 765 fluidly connected between the heat exchanger 490 and the drive 616. The secondary refrigerant loop 460 diverges downstream of the heat exchanger 490 into the economization duct 465, the first supply duct 565, the second supply duct 665, and the third supply duct 765. Portions of the refrigerant flow in the secondary refrigerant loop 460 flow through the economization duct 465, the first supply duct 565, and the second supply duct 665, as described above with respect to the fourth example vapor compression system 1100. The remainder of the refrigerant flow in the secondary refrigerant loop 460 flows through the third supply duct 765 to provide a third flow of refrigerant to the drive 616.

The third supply duct 765 includes a third valve 770 fluidly connected thereto. The third valve 770 is controlled by the controller 610 and selectively positionable to permit refrigerant to flow therethrough. When the third valve 770 is fully closed, and when at least one of the economization valve 470, the first valve 570, and the second valve 670 is open, all of the refrigerant in the secondary refrigerant loop 460 will flow through the economization duct 465, the first supply duct 565, and/or the second supply duct 665, and the system 1200 will operate in substantially the same manner as the system 1100 illustrated in FIG. 8. When the third valve 770 is fully or partially open, the gaseous or two-phase refrigerant exiting the heat exchanger 490 separates into up to four streams, with a portion of refrigerant flowing through the economization duct 465, another portion flowing through the first supply duct 565, another portion flowing through the second supply duct 665, and the remainder being diverted through the third supply duct 765. The third valve 770 can be a solenoid valve (as shown in FIG. 9), an electronic expansion valve, or any type of valve that allows the system 1200 to function as described herein.

When the third valve 770 is open, the third supply duct 765 provides a third flow of refrigerant to facilitate cooling of the drive 616. The third supply duct 765 is fluidly connected to the return duct 520, and the first, second, and third flows combine to form the return flow that is mixed with the refrigerant flow upstream of the compressor inlet 110.

In further embodiments (not shown), vapor compression systems of the present disclosure may include any combination of the economization duct 465, first supply duct 565, second supply duct 665, third supply duct 765, and return duct 520 in any suitable configuration.

The memory 612 stores instructions that program the processor 611 to control the supply of refrigerant to the compressor 100, motor 108, and drive 616 based on operating parameters of each component. Example control algorithms are shown in FIGS. 10-15. The processor 611 operates the dynamic compressor 100 to compress the refrigerant and operates the cooling apparatus 560 to provide a flow of refrigerant through the first supply duct 565 to one or more bearing assembly 200 of the dynamic compressor 100. While operating the dynamic compressor 100 and the cooling apparatus 560, the processor 611 determines if a condition is satisfied. If the condition is satisfied, the instructions stored in the memory 612 program the processor 611 to adjust a position of a valve in fluid communication between the dynamic compressor 100 and the cooling apparatus 560.

Figure 10:
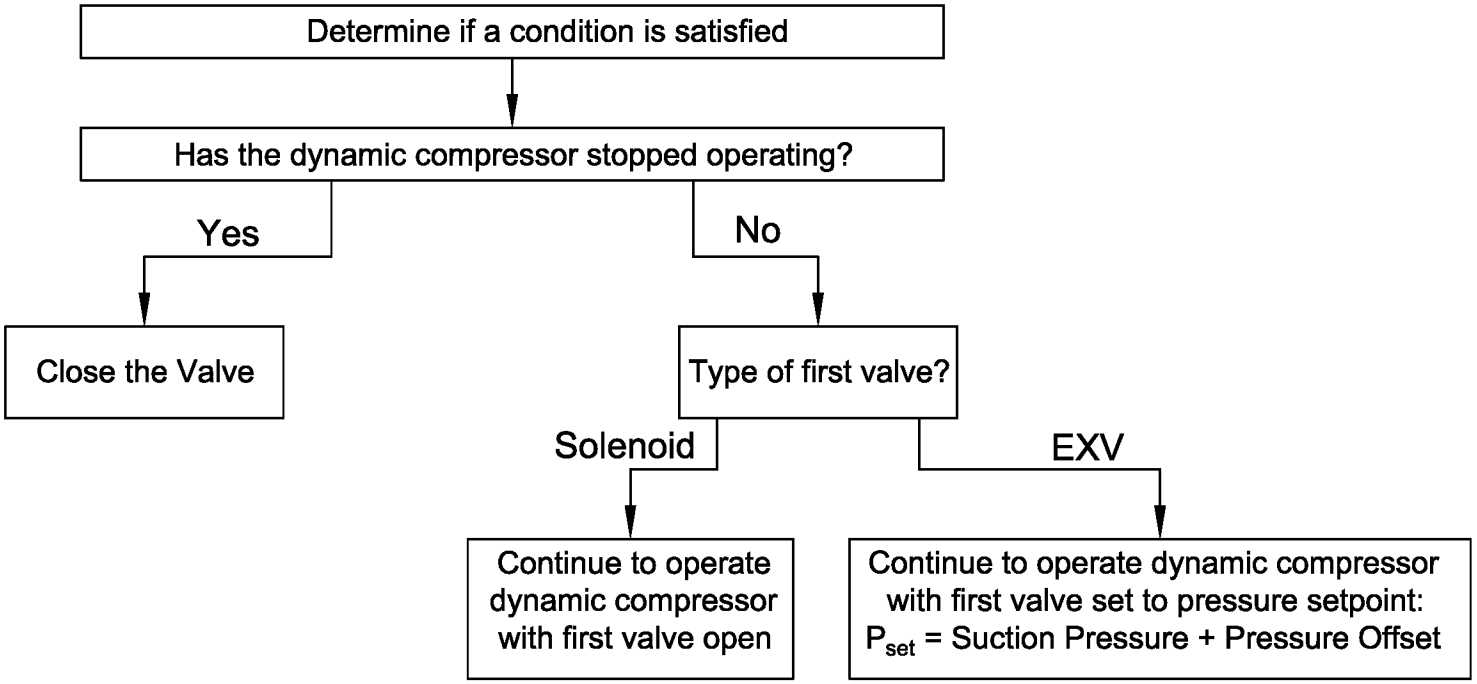
FIG. 10 is an example control algorithm for controlling a first flow of refrigerant to the bearing assembly.
Figure 11:
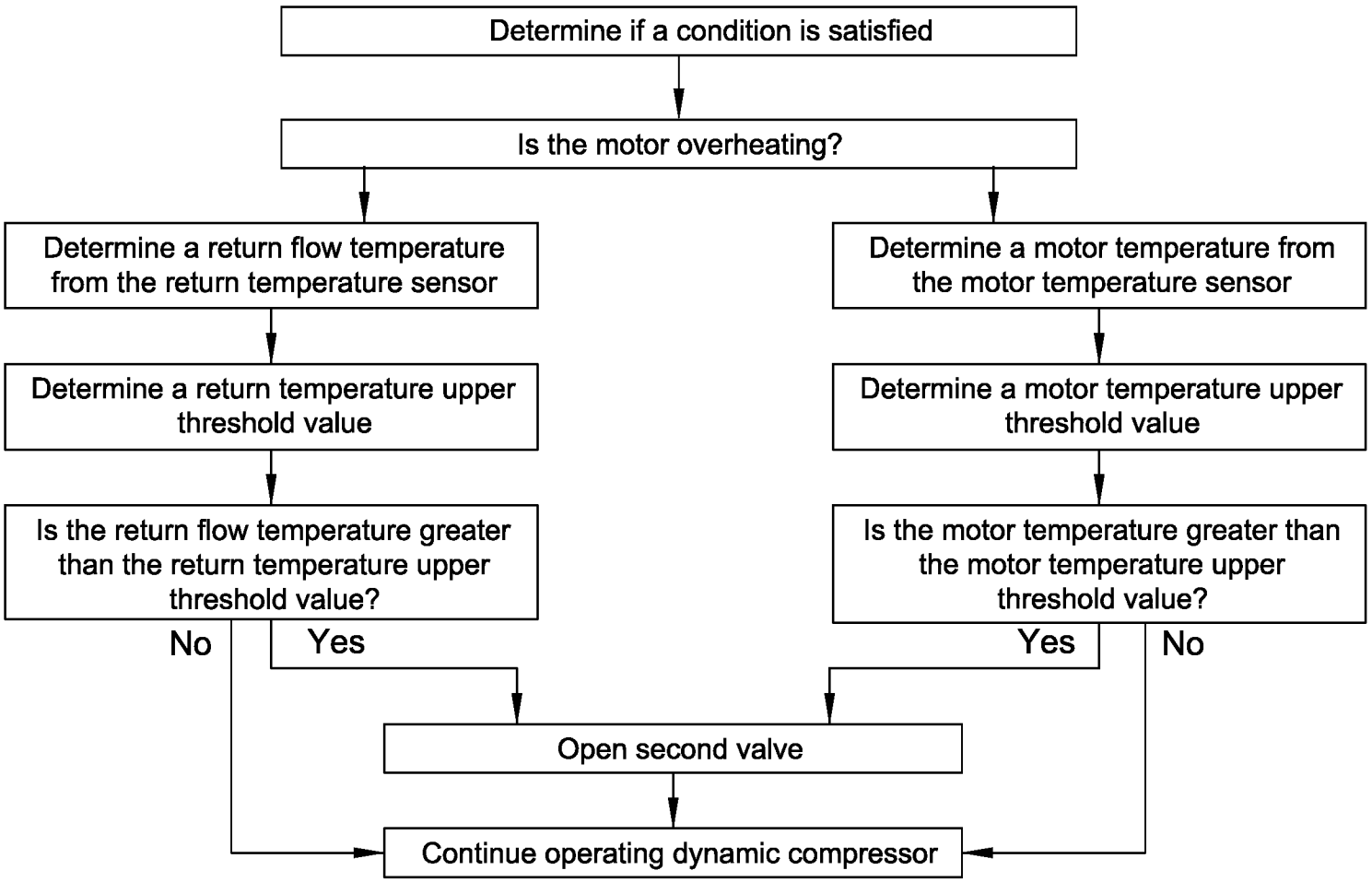
FIG. 11 is a first example control algorithm for controlling a second flow of refrigerant to a motor.
Figure 12:
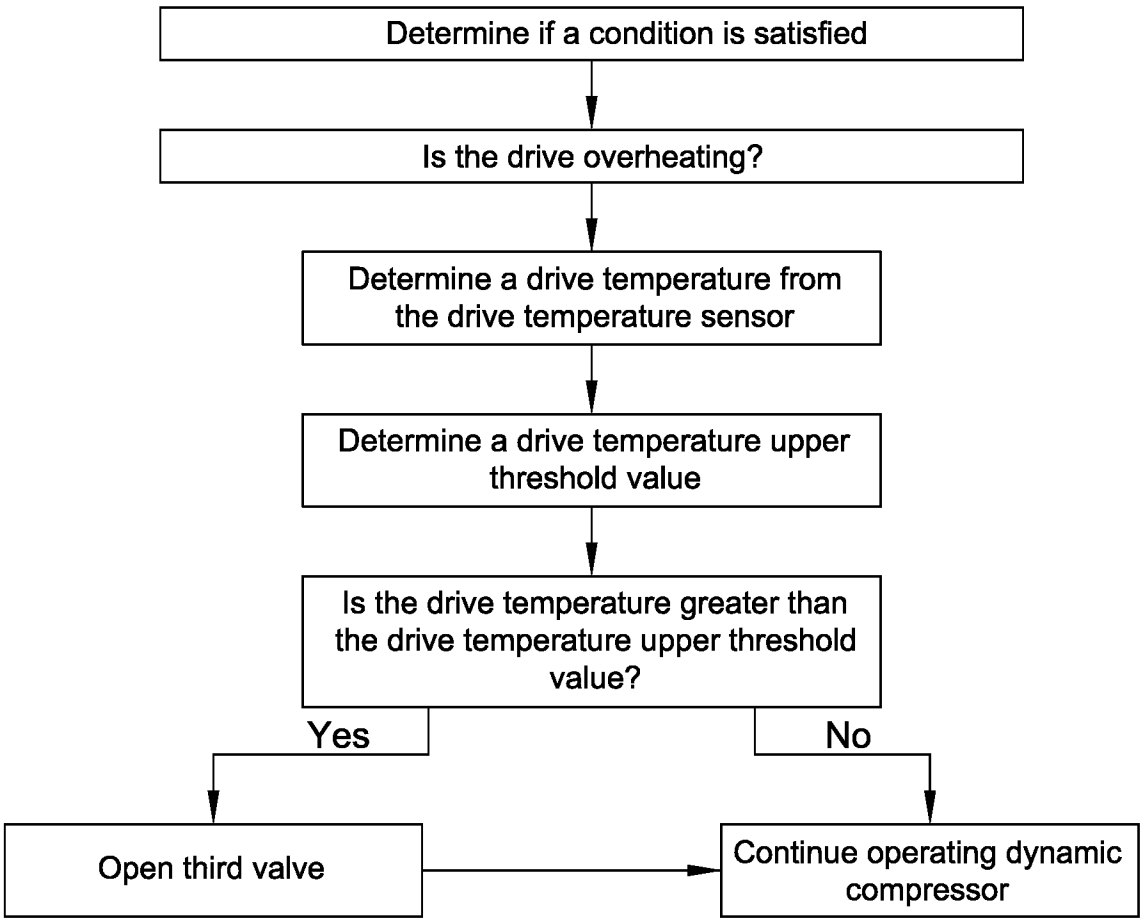
FIG. 12 is a second example control algorithm for controlling the second flow of refrigerant to the drive.

In some embodiments, and with reference to FIG. 10, determining if a condition is satisfied includes determining that the condition is satisfied when the dynamic compressor 100 is no longer operating. In such embodiments, adjusting a position of a valve includes closing the first valve 570 to suspend the supply of refrigerant to the bearing assembly(s) 200. The condition is determined to be not satisfied when the dynamic compressor 100 is determined to still be operating. When the dynamic compressor 100 is determined to still be operating, and in embodiments in which the first valve 570 is a solenoid valve, the instructions stored in the memory 612 program the processor 611 to continue to operate the dynamic compressor 100 with the first valve 570 open. In embodiments in which the first valve 570 is an electronic expansion valve (EXV), the instructions stored in the memory 612 program the processor 611 to continue to operate the dynamic compressor 100 with the first valve 570 set to a pressure setpoint. In some embodiments, the pressure setpoint $P_{set}$ is equal to the sum of the suction pressure $P_{suction}$ at the inlet 110 of the dynamic compressor 100 and a pressure offset $P_{offset}$:

$$P_{set}=P_{suction}+P_{offset}$$

The pressure offset $P_{offset}$ may be 1 psi, 2 psi, or any other suitable pressure offset that creates a sufficient pressure differential to cause refrigerant to flow through the bearing assembly 200.

In embodiments in which the cooling apparatus 560 includes a second supply duct 665 and a second valve 670 fluidly connected thereto, the instructions stored in the memory 612 program the processor 611 to determine whether the motor 108 is overheating based on the measured temperature of the return flow or the motor 108. For example, and with reference to FIG. 11, determining if the motor 108 is overheating may include determining a temperature of the return flow temperature $T_r$ measured by the return temperature sensor and determining a return temperature upper threshold value $T_{r,up}$. In some embodiments, the return temperature upper threshold value $T_{r,up}$ may be, for example and without limitation, 130° F. or 140° F. The condition is determined to be satisfied when the temperature of the return flow $T_r$ is greater than the return temperature upper threshold value $T_{r,up}$. In other embodiments, determining if the motor 108 is overheating may include determining a motor temperature $T_m$ measured by the motor temperature sensor and determining a motor temperature upper threshold value $T_{m,up}$. In some embodiments, the motor temperature upper threshold value $T_{m,up}$ may be, for example and without limitation, 180° F. or 200° F. The condition is determined to be satisfied when the motor temperature $T_m$ is greater than the motor temperature upper threshold value $T_{m,up}$.

When the condition is satisfied in either such case, the motor 108 is determined to be overheating and in need of cooling. Accordingly, adjusting a position of a valve in such embodiments includes opening the second valve 670 to provide the second flow of refrigerant to the motor 108. When the condition is not determined to be satisfied, and the motor 108 is not determined to be overheating, the instructions stored in the memory 612 program the processor 611 to continue to operate the dynamic compressor 100 without adjusting the position of the second valve 670.

In embodiments in which the cooling apparatus 560 includes a third supply duct 765 and a third valve fluidly connected thereto, the instructions stored in the memory 612 program the processor 611 to determine whether the drive 616 is overheating based on the temperature of the drive 616 measured by the drive temperature sensor. In such embodiments, and with reference to FIG. 12, determining that the drive 616 is overheating includes determining a drive temperature $T_d$ and determining a drive temperature upper threshold value $T_{d,up}$. In some embodiments, the drive temperature upper threshold value $T_{d,up}$ may be, for example and without limitation, 160° F. or 180° F. The condition is determined to be satisfied when the drive temperature $T_d$ is greater than the drive temperature upper threshold value $T_{d,up}$.

When the condition is satisfied, the drive 616 is determined to be overheating and in need of cooling. Accordingly, adjusting a position of a valve in such embodiments includes opening the third valve 770 to provide the third flow of refrigerant to the drive 616. When the condition is not determined to be satisfied, and the drive 616 is not determined to be overheating, the instructions stored in the memory 612 program the processor 611 to continue to operate the dynamic compressor 100 without adjusting the position of the third valve 770.

In some embodiments, the condition is a first condition, and the instructions stored in the memory 612 further program the processor 611 to determine if a second condition is satisfied, and to adjust the position of a valve when the second condition is satisfied. For example, the instructions stored in the memory 612 program the processor 611 to determine whether the motor 108 and drive 616 have been sufficiently cooled after the second or third valve 670, 770 has been opened.

Figure 13:
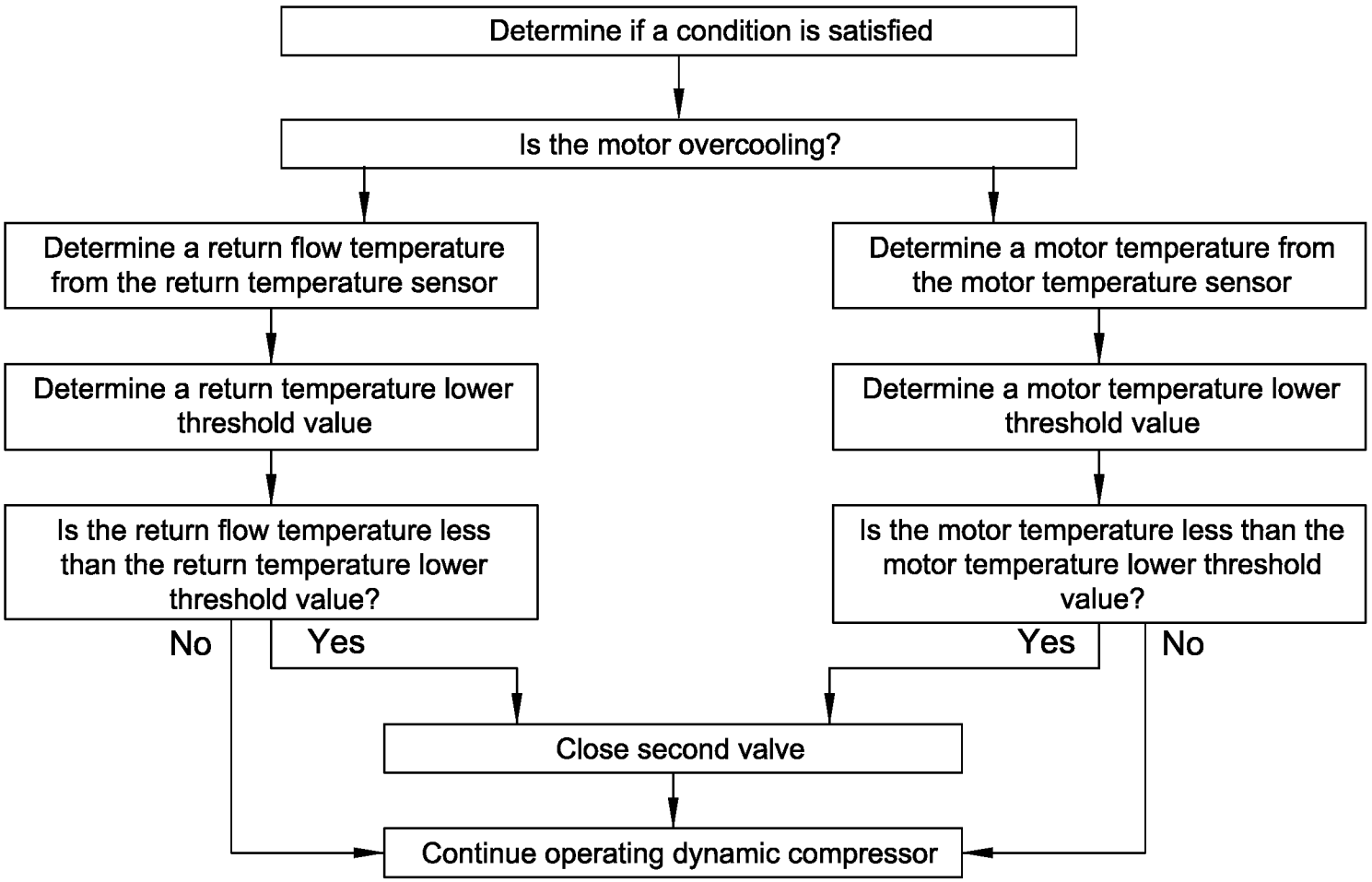
FIG. 13 is a first example control algorithm for controlling a third flow of refrigerant to a motor.

For example, and with reference to FIG. 13, determining if the motor 108 is overcooling may include determining the temperature of the return flow T r and determining a return temperature lower threshold value $T_{r,low}$. In some embodiments, the return temperature lower threshold value $T_{r,low}$ is the difference between the return temperature upper threshold value $T_{r,up}$ and a return temperature deadband value $T_{r,db}$:

$$T_{r,low}=T_{r,up}-T_{r,db}$$

Determining if the motor 108 is overcooling may also include determining the motor temperature $T_m$ and determining a motor temperature lower threshold value $T_{m,low}$. In some embodiments, the motor temperature lower threshold value $T_{m,low}$ is the difference between the motor temperature upper threshold value $T_{m,up}$ and a motor temperature deadband value $T_{m,db}$:

$$T_{m,low}=T_{m,up}-T_{m,db}$$

The motor temperature deadband may be, for example and without limitation, 10 or 15 degrees Fahrenheit. The second condition is determined to be satisfied when the temperature of the return flow $T_r$ is less than the return temperature lower threshold value $T_{r,low}$, and/or the motor temperature $T_m$ is less than the motor temperature lower threshold value $T_{m,low}$.

When the second condition is satisfied in either such case, the motor 108 is determined to be sufficiently cooled and no longer in need of cooling. Accordingly, adjusting a position of a valve in such embodiments includes closing the second valve 670 to terminate the second flow of refrigerant to the motor 108. When the second condition is not determined to be satisfied, and the motor 108 is not determined to be overcooling, the instructions stored in the memory 612 program the processor 611 to continue to operate the dynamic compressor 100 with the second valve 670 open.

Figure 14:
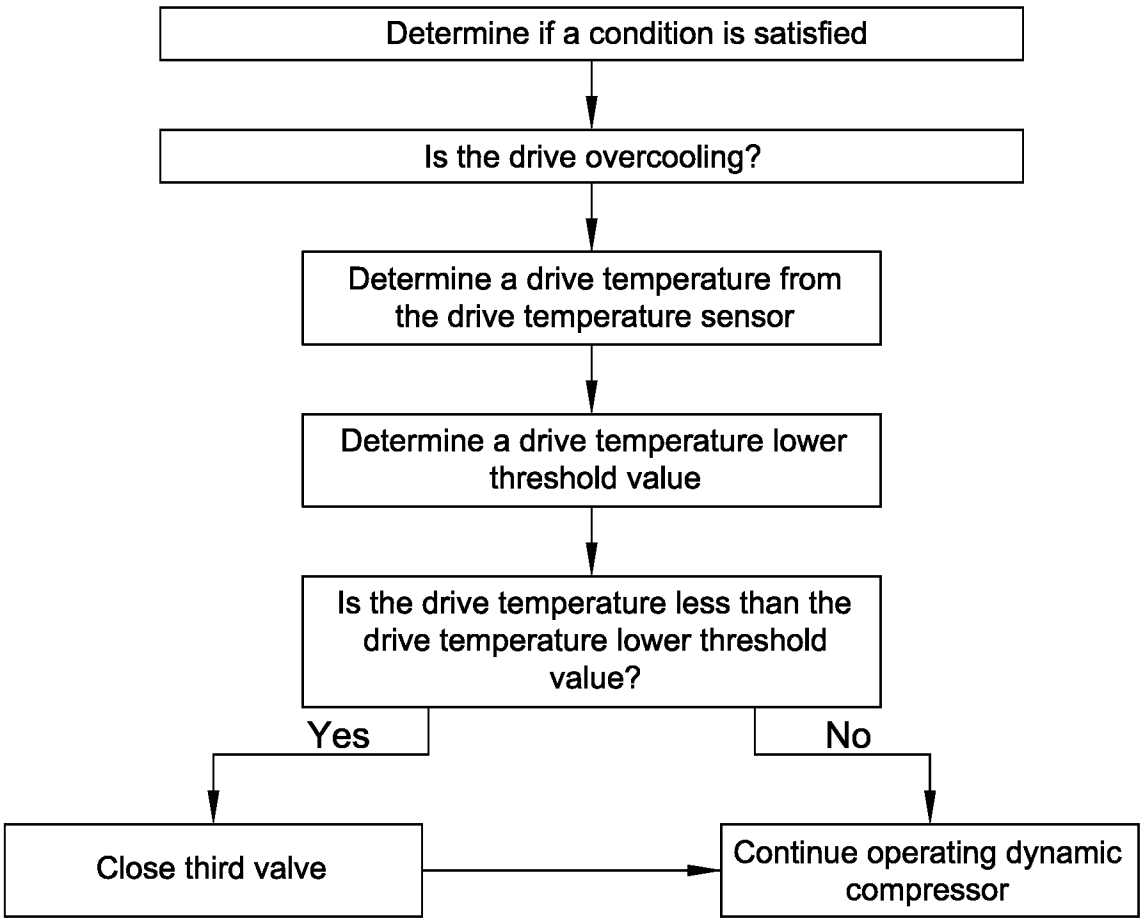
FIG. 14 is a second example control algorithm for controlling the third flow of refrigerant to the drive.

Similarly, and with reference to FIG. 14, determining if the drive 616 is overcooling may include determining the measured drive temperature $T_d$ and determining a drive temperature lower threshold value $T_{d,low}$. In some embodiments, the drive temperature lower threshold value $T_{d,low}$ is the difference between the drive temperature upper threshold value $T_{d,up}$ and a drive temperature deadband value $T_{d,db}$:

$$T_{d,low}=T_{d,up}-T_{d,db}$$

The second condition is determined to be satisfied when the measured drive temperature $T_d$ is less than the drive temperature lower threshold value $T_{m,low}$.

When the second condition is satisfied in such embodiments, the drive 616 is determined to be sufficiently cooled and no longer in need of cooling. Accordingly, adjusting a position of a valve in such embodiments includes closing the third valve 770 to terminate the third flow of refrigerant to the drive 616. When the second condition is not determined to be satisfied, and the drive 616 is not determined to be overcooling, the instructions stored in the memory 612 program the processor 611 to continue to operate the dynamic compressor 100 with the third valve 770 open.

Figure 15:
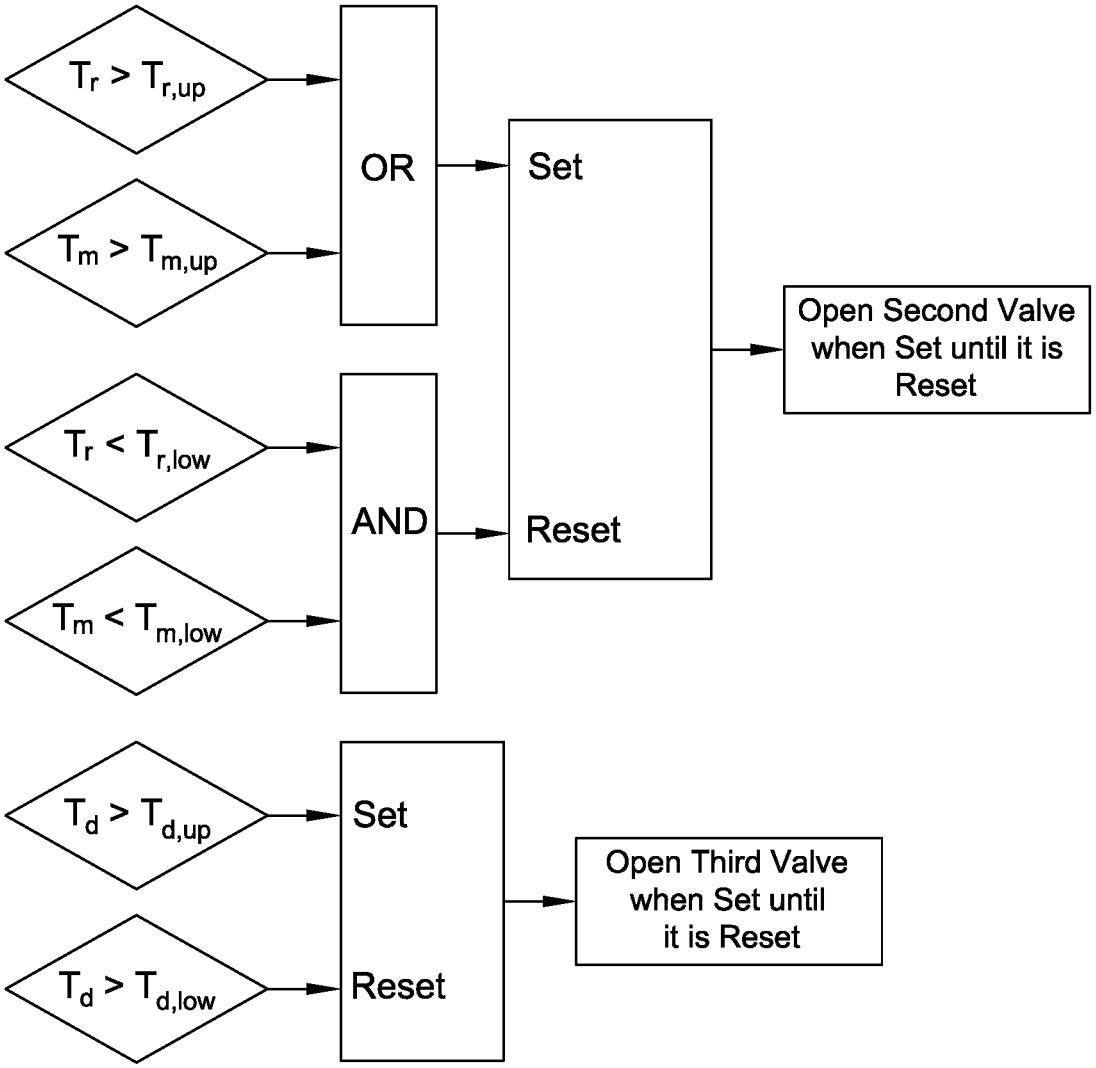
FIG. 15 is a flow chart of the example control algorithms shown in FIGS. 10-14.

FIG. 15 is a flow chart of the example control algorithms shown in FIGS. 11-14 for controlling operation of the cooling apparatus 560 when the motor 108 or drive 616 is overheating or overcooling. When the return flow temperature $T_r$ and/or the motor temperature $T_m$ has exceeded its respective upper threshold value $T_{r,up}$, $T_{m,up}$, the second valve 670 is set to open. Subsequently, when both the return flow temperature $T_r$ and the motor temperature $T_m$ have dropped below their respective lower threshold values $T_{r,low}$, $T_{m,low}$, the second valve 670 is reset to close. Similarly, when the drive temperature $T_d$ has exceeded its upper threshold value $T_{d,up}$, the third valve 770 is set to open. Subsequently, when the drive temperature $T_d$ drops below its lower threshold value $T_{d,low}$, the third valve 770 is reset to close.

Technical benefits of the methods and systems described include that the vapor compression system can use an existing vapor path from an economization system to provide vapor injection cooling to the bearings, motor, and drive of a dynamic compressor. In addition, the bearings, motor, and drive of a dynamic compressor can be cooled using vapor injection with no risk of flooding the bearings or compressor flow path with liquid. Vapor injection is also better suited for the small amount of cooling required by the bearings.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A vapor compressor system comprising:

a primary loop comprising:

a dynamic compressor operable to compress a refrigerant, the dynamic compressor including:

a housing;

a shaft supported in the housing by a bearing;

an impeller operably connected to the shaft to drive rotation thereof; and a drive operably to control the motor;

a condenser fluidly connected to the dynamic compressor;

a first expansion device fluidly connected to the condenser; and an evaporator fluidly connected to the first expansion device and the dynamic compressor; and a secondary loop comprising:

a second expansion device fluidly connected to the condenser;

a heat exchanger fluidly connected to the second expansion device, the condenser, and the dynamic compressor; and a supply duct fluidly connected between the heat exchanger and the dynamic compressor to provide a flow of refrigerant to the bearing, wherein the supply duct provides the flow of refrigerant to the bearing prior to mixing with the refrigerant of the primary loop flowing through the dynamic compressor.

2. The vapor compression system of claim 1, wherein the supply duct includes a valve operable to control the flow of refrigerant through the supply duct, wherein the valve is selectively positionable between an open position and a closed position when it is determined that the dynamic compressor is not operating.

3. The vapor compression system of claim 1, wherein the heat exchanger is a flash tank.

4. The vapor compression system of claim 1, wherein the secondary loop further comprises a return duct for fluidly connecting the supply duct to the dynamic compressor to provide a return flow of refrigerant to the dynamic compressor.

5. The vapor compression system of claim 1, wherein the supply duct is a first supply duct and the flow of refrigerant provided to the bearing is a first flow of refrigerant, wherein the secondary loop further comprises a second supply duct for fluidly connecting the heat exchanger to the motor to provide a second flow of refrigerant to the motor.

6. The vapor compression system of claim 5, wherein the secondary loop further comprises a third supply duct for fluidly connecting the heat exchanger to the drive to provide a third flow of refrigerant to the drive.

7. The vapor compression system of claim 6, wherein the secondary loop further comprises a return duct for fluidly connecting the first, second, and third supply ducts to the dynamic compressor to provide a return flow of refrigerant to the dynamic compressor.

8. The vapor compression system of claim 1, wherein the secondary loop further comprises an economization duct, separate from the supply duct, for fluidly connecting the heat exchanger to the dynamic compressor to provide an economization flow of refrigerant to the dynamic compressor between a first stage and a second stage thereof.

9. A controller for a compressor system including a dynamic compressor and a cooling apparatus, the cooling apparatus including a heat exchanger and a supply duct fluidly connected between the heat exchanger and the dynamic compressor, the controller comprising:

a processor; and a memory, the memory storing instructions that program the processor to:

operate the dynamic compressor to compress a refrigerant;

operate the cooling apparatus to provide a flow of refrigerant through the supply duct to a bearing of the dynamic compressor;

determine if a condition is satisfied; and adjust a position of a valve in fluid communication between the dynamic compressor and the cooling apparatus when the condition is satisfied, wherein the valve is a first valve fluidly connected to the supply duct between the heat exchanger and the at least one bearing, wherein determining if the condition is satisfied comprises determining that the condition is satisfied when the dynamic compressor is no longer operating, and wherein adjusting the position of the valve comprises closing the first valve.

10. The controller of claim 9, wherein the supply duct is a first supply duct and the flow of refrigerant is a first flow of refrigerant, wherein the cooling apparatus further includes a second supply duct for fluidly connecting the heat exchanger to a motor operatively connected to the dynamic compressor, and wherein the second supply duct provides a second flow of refrigerant to the motor.

11. The controller of claim 10, wherein the cooling apparatus further includes a second valve fluidly connected to the second supply duct between the heat exchanger and the motor, a return duct for fluidly connecting the first and second supply ducts to the dynamic compressor to provide a return flow of refrigerant to the dynamic compressor, and a return temperature sensor operable to measure a temperature of the return flow, wherein determining if the condition is satisfied comprises determining that the condition is satisfied when the temperature of the return flow is greater than a return temperature upper threshold value, and wherein adjusting the position of a valve comprises opening the second valve.

12. The controller of claim 10, wherein the motor includes a motor temperature sensor operable to measure a temperature of the motor, wherein determining if the condition is satisfied comprises determining that the condition is satisfied when the temperature of the motor is greater than a motor temperature upper threshold value, and wherein adjusting the position of a valve comprises opening a second valve fluidly connected to the second supply duct between the heat exchanger and the motor.

13. The controller of claim 10, wherein the cooling apparatus further includes a third supply duct for fluidly connecting the heat exchanger to a drive operable to control the motor, and wherein the third supply duct provides a third flow of refrigerant to the drive.

14. The controller of claim 13, wherein the drive includes a drive temperature sensor operable to measure a temperature of the drive, wherein determining if the condition is satisfied comprises determining that the condition is satisfied when the temperature of the drive is greater than a drive temperature upper threshold value, and wherein adjusting the position of a valve comprises opening a third valve fluidly connected to the third supply duct between the heat exchanger and the drive.

15. The controller of claim 9, wherein the condition is a first condition, and the memory further stores instructions that program the processor to:

determine if a second condition is satisfied; and adjust the position of the valve when the second condition is satisfied.

16. The controller of claim 15, wherein the supply duct is a first supply duct and the flow of refrigerant is a first flow of refrigerant, and wherein the cooling apparatus further includes:

a second supply duct for supplying a second flow of refrigerant from the heat exchanger to a motor operatively connected to the dynamic compressor;

a second valve fluidly connected to the second supply duct;

a return duct for supplying a return flow of refrigerant from the first and second supply ducts to the dynamic compressor; and a return temperature sensor operable to measure a temperature of the return flow, wherein determining if the second condition is satisfied comprises determining that the second condition is satisfied when the temperature of the return flow is less than a return temperature lower threshold value, and wherein adjusting the position of the valve comprises closing the second valve.

17. The controller of claim 15, wherein the supply duct is a first supply duct and the flow of refrigerant is a first flow of refrigerant, and wherein the cooling apparatus further includes:

a second supply duct for supplying a second flow of refrigerant from the heat exchanger to a motor operatively connected to the dynamic compressor;

a second valve fluidly connected to the second supply duct;

a return duct for supplying a return flow of refrigerant from the first and second supply ducts to the dynamic compressor; and a motor temperature sensor operable to measure a temperature of the motor, wherein determining if the second condition is satisfied comprises determining that the second condition is satisfied when the temperature of the motor is less than a motor temperature lower threshold value, and wherein adjusting the position of the valve comprises closing the second valve.

18. The controller of claim 15, wherein the supply duct is a first supply duct and the flow of refrigerant is a first flow of refrigerant, and wherein the cooling apparatus further includes:

a third supply duct for supplying a third flow of refrigerant from the heat exchanger to a drive operable to control a motor operatively connected to the dynamic compressor;

a third valve fluidly connected to the third supply duct; and a drive temperature sensor operable to measure a temperature of the drive, wherein determining if the second condition is satisfied comprises determining that the second condition is satisfied when the temperature of the drive is less than a drive temperature lower threshold valve, and wherein adjusting the position of the valve comprises closing the third valve.

19. A compressor system comprising:

a dynamic compressor operable to compress a refrigerant, the dynamic compressor comprising:

a housing;

a shaft supported in the housing by a bearing; and an impeller connected to the shaft; and a cooling apparatus comprising:

a heat exchanger fluidly connected to the dynamic compressor;

a supply duct fluidly connected between the heat exchanger and the dynamic compressor to provide a flow of refrigerant to the bearing;

a valve fluidly connected to the supply duct and selectively positionable from an open position to permit refrigerant to flow through the supply duct to a closed position; and a controller operable to position the valve in the closed position when it is determined that the dynamic compressor is not operating.

* * * * *